US008866687B2

(12) United States Patent
Biancotto et al.

(10) Patent No.: US 8,866,687 B2
(45) Date of Patent: Oct. 21, 2014

(54) MODULAR FEED NETWORK

(71) Applicant: Andrew LLC, Hickory, NC (US)

(72) Inventors: Claudio Biancotto, Edinburgh (GB); Christopher D Hills, Glenrothes (GB); Alexander Thomson, Livingston (GB)

(73) Assignee: Andrew LLC, Hickory, NC (US)

( * ) Notice: Subject to any disclaimer, the term of this patent is extended or adjusted under 35 U.S.C. 154(b) by 155 days.

(21) Appl. No.: 13/677,862

(22) Filed: Nov. 15, 2012

(65) Prior Publication Data

US 2013/0120206 A1 May 16, 2013

Related U.S. Application Data

(63) Continuation-in-part of application No. 13/297,304, filed on Nov. 16, 2011, now Pat. No. 8,558,746.

(51) Int. Cl.

| | |
|---|---|
| ***H01Q 13/10*** | (2006.01) |
| ***H01P 11/00*** | (2006.01) |
| ***H01Q 21/06*** | (2006.01) |
| *H01Q 21/00* | (2006.01) |

(52) U.S. Cl.

CPC ..... *H01Q 21/005* (2013.01); *H01Q 21/0087* (2013.01); *H01P 11/00* (2013.01); *H01Q 21/064* (2013.01); *H01Q 21/0043* (2013.01)

USPC ..... 343/776; 343/771; 343/853; 343/858

(58) Field of Classification Search

CPC ..... H01Q 21/005; H01Q 21/064; H01Q 21/0043; H01Q 21/0087

USPC ..... 343/771, 776, 853, 858; 29/600

See application file for complete search history.

(56) References Cited

U.S. PATENT DOCUMENTS

| | | | |
|---|---|---|---|
| 2,573,746 | A | 11/1951 | Watson et al. |
| 2,981,948 | A | 4/1961 | Kurtz |
| 3,157,847 | A | 11/1964 | Williams |
| 3,193,830 | A | 7/1965 | Provencher |
| 3,243,818 | A | 3/1966 | Holtzman |
| 3,281,851 | A | 10/1966 | Goebels, Jr. |

(Continued)

FOREIGN PATENT DOCUMENTS

| | | |
|---|---|---|
| KR | 100721871 | 5/2007 |
| WO | 9639730 | 12/1996 |

OTHER PUBLICATIONS

Sung Chul Kang, International Search Report of Counterpart International Application No. PCT/US12/65427, Mar. 29, 2013, Daejeon Metropolitan City, Korea.

*Primary Examiner* — Dieu H Duong

(74) *Attorney, Agent, or Firm* — Babcock IP, PLLC

(57) ABSTRACT

A modular feed network is provided with a segment base provided with a feed aperture, a corner cavity at each corner and a tap cavity at a mid-section of each of two opposite sides. A segment top is provided with a plurality of output ports. The segment top is dimensioned to seat upon the segment base to form a segment pair. the segment base provided with a plurality of waveguides between cavities of the segment base. The modular feed network is configurable via a range of feed, bypass and/or power divider taps seated in the apertures and/or cavities to form a waveguide network of varied numbers of output ports by routing across one or more of the segment tops. For example, the modular feed network may comprise 1, 4 or 16 of the segment bases retained side to side.

20 Claims, 16 Drawing Sheets

(56) References Cited

U.S. PATENT DOCUMENTS

| | | | |
|---|---|---|---|
| 3,340,534 | A | 9/1967 | Fee |
| 3,570,007 | A | 3/1971 | Whitehead |
| 3,599,216 | A | 8/1971 | Paine et al. |
| 3,701,162 | A | 10/1972 | Seaton |
| 3,999,151 | A | 12/1976 | Baldwin et al. |
| 4,121,220 | A | 10/1978 | Scillieri et al. |
| 4,429,313 | A | 1/1984 | Muhs, Jr. et al. |
| 4,527,165 | A | 7/1985 | de Ronde |
| 4,679,011 | A | 7/1987 | Praba et al. |
| 4,716,415 | A | 12/1987 | Kelly |
| 4,812,788 | A | 3/1989 | Wong et al. |
| 4,829,309 | A | 5/1989 | Tsukamoto et al. |
| 4,857,938 | A | 8/1989 | Tsukamoto et al. |
| 4,878,060 | A | 10/1989 | Barbier et al. |
| 4,916,458 | A | 4/1990 | Goto |
| 4,949,092 | A | 8/1990 | Crail et al. |
| 4,959,658 | A | 9/1990 | Collins |
| 4,985,708 | A | 1/1991 | Kelly |
| 5,010,351 | A | 4/1991 | Kelly |
| 5,019,831 | A | 5/1991 | Yee et al. |
| 5,086,304 | A | 2/1992 | Collins |
| 5,210,543 | A | 5/1993 | Kurtz |
| 5,243,354 | A | 9/1993 | Stern et al. |
| 5,247,268 | A | 9/1993 | Meise |
| 5,270,721 | A | 12/1993 | Tsukamoto et al. |
| 5,321,411 | A | 6/1994 | Tsukamoto et al. |
| 5,327,150 | A | 7/1994 | Cherrette |
| 5,337,065 | A | 8/1994 | Bonnet et al. |
| 5,512,906 | A | 4/1996 | Speciale |
| 5,541,612 | A | 7/1996 | Josefsson |
| 5,579,019 | A | 11/1996 | Uematsu et al. |
| 5,589,843 | A | 12/1996 | Meredith et al. |
| 5,619,216 | A | 4/1997 | Park |
| 5,650,793 | A | 7/1997 | Park |
| 5,831,583 | A | 11/1998 | Lagerstedt et al. |
| 5,880,695 | A | 3/1999 | Brown et al. |
| 5,926,147 | A | 7/1999 | Sehm et al. |
| 6,101,705 | A | 8/2000 | Wolfson et al. |
| 6,127,985 | A | 10/2000 | Guler |
| 6,198,456 | B1 | 3/2001 | Le Halle et al. |
| 6,201,508 | B1 | 3/2001 | Metzen et al. |
| 6,225,960 | B1 | 5/2001 | Collins |
| 6,285,335 | B1 | 9/2001 | Snygg et al. |
| 6,297,782 | B1 | 10/2001 | Matthews et al. |
| 6,304,228 | B1 | 10/2001 | Smith et al. |
| 6,476,772 | B1 | 11/2002 | Smith et al. |
| 6,535,173 | B2 | 3/2003 | Ou |
| 6,624,787 | B2 | 9/2003 | Puzella et al. |
| 6,657,599 | B2 | 12/2003 | Solbach |
| 6,720,931 | B1 | 4/2004 | Michisaka et al. |
| 6,731,241 | B2 | 5/2004 | Park et al. |
| 6,796,126 | B2 | 9/2004 | Hasegawa et al. |
| 6,861,996 | B2 | 3/2005 | Jeong |
| 6,950,066 | B2 | 9/2005 | Hendler et al. |
| 6,977,621 | B2 | 12/2005 | Kelly et al. |
| 7,064,725 | B2 | 6/2006 | Shtrikman et al. |
| 7,205,948 | B2 | 4/2007 | Krikorian et al. |
| 7,227,508 | B2 | 6/2007 | Wang et al. |
| 7,391,381 | B2 | 6/2008 | Wang et al. |
| D576,344 | S | 9/2008 | Conroy |
| 7,607,942 | B1 | 10/2009 | Van Swearingen |
| 7,663,566 | B2 | 2/2010 | Engel |
| 7,680,516 | B2 | 3/2010 | Lovberg et al. |
| 7,817,097 | B2 | 10/2010 | Margomenos |
| 7,948,443 | B2 | 5/2011 | Bullock et al. |
| 8,010,042 | B2 | 8/2011 | Judd et al. |
| 8,040,286 | B2 | 10/2011 | Matusuo et al. |
| 2004/0080463 | A1 | 4/2004 | Jeong |
| 2009/0302971 | A1 | 12/2009 | Rosenberg et al. |
| 2010/0066463 | A1 | 3/2010 | Rosenberg et al. |
| 2010/0231475 | A1 | 9/2010 | Ou et al. |

MODULAR FEED NETWORK

CROSS REFERENCE TO RELATED APPLICATIONS

This application is a continuation-in-part of commonly owned co-pending U.S. Utility patent application Ser. No. 13/297,304, titled "Flat Panel Array Antenna" filed Nov. 16, 2011 by Alexander P. Thomson, Claudio Biancotto and Christopher D. Hills, hereby incorporated by reference in its entirety.

BACKGROUND

1. Field of the Invention

This invention relates to a microwave antenna. More particularly, the invention provides a flat panel array antenna utilizing cavity coupling to simplify corporate feed network requirements.

2. Description of Related Art

Flat panel array antenna technology has not been extensively applied within the licensed commercial microwave point to point or point to multipoint market, where more stringent electromagnetic radiation envelope characteristics consistent with efficient spectrum management are common. Antenna solutions derived from traditional reflector antenna configurations such as prime focus fed axi-symmetric geometries provide high levels of antenna directivity and gain at relatively low cost. However, the extensive structure of a reflector dish and associated feed may require significantly enhanced support structure to withstand wind loads, which may increase overall costs. Further, the increased size of reflector antenna assemblies and the support structure required may be viewed as a visual blight.

Array antennas typically utilize either printed circuit technology or waveguide technology. The components of the array which interface with free-space, known as the elements, typically utilize microstrip geometries, such as patches, dipoles or slots, or waveguide components such as horns, or slots respectively. The various elements are interconnected by a feed network, so that the resulting electromagnetic radiation characteristics of the antenna conform to desired characteristics, such as the antenna beam pointing direction, directivity, and sidelobe distribution.

Flat panel arrays may be formed, for example, using waveguide or printed slot arrays in either resonant or travelling wave configurations. Resonant configurations typically cannot achieve the requisite electromagnetic characteristics over the bandwidths utilized in the terrestrial point-to-point market sector, whilst travelling wave arrays typically provide a mainbeam radiation pattern which moves in angular position with frequency. Because terrestrial point to point communications generally operate with Go/Return channels spaced over different parts of the frequency band being utilized, movement of the mainbeam with respect to frequency may prevent simultaneous efficient alignment of the link for both channels.

Corporate fed waveguide or slot elements may enable fixed beam antennas exhibiting suitable characteristics. However, it may be necessary to select an element spacing which is generally less than one wavelength, in order to avoid the generation of secondary beams known as grating lobes, which do not respect regulatory requirements, and detract from the antenna efficiency. This close element spacing may conflict with the feed network dimensions. For example, in order to accommodate impedance matching and/or phase equalization, a larger element spacing is required to provide sufficient volume to accommodate not only the feed network, but also sufficient material for electrical and mechanical wall contact between adjacent transmission lines (thereby isolating adjacent lines and preventing unwanted interline coupling/cross-talk).

The elements of antenna arrays may be characterized by the array dimensions, such as a $2^N \times 2^M$ element array where N and M are integers. In a typical N×M corporate fed array, (N×M)−1 T-type power dividers may be required, along with N×M feed bends and multiple N×M stepped transitions in order to provide acceptable VSWR performance. Thereby, the feed network requirements may be a limiting factor of space efficient corporate fed flat panel arrays.

Therefore it is an object of the invention to provide an apparatus that overcomes limitations in the prior art, and in so doing present a solution that allows such a flat panel antenna to provide electrical performance approaching that of much larger traditional reflector antennas which meet the most stringent electrical specifications over the operating band used for a typical microwave communication link.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

Figure 1:
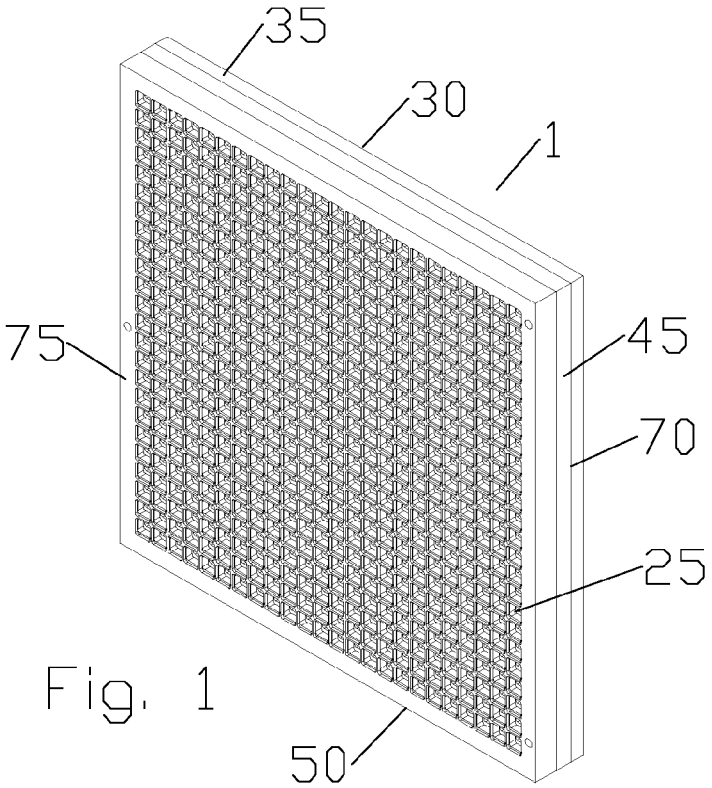
FIG. 1 is a schematic isometric angled front view of an exemplary flat panel antenna.
Figure 2:
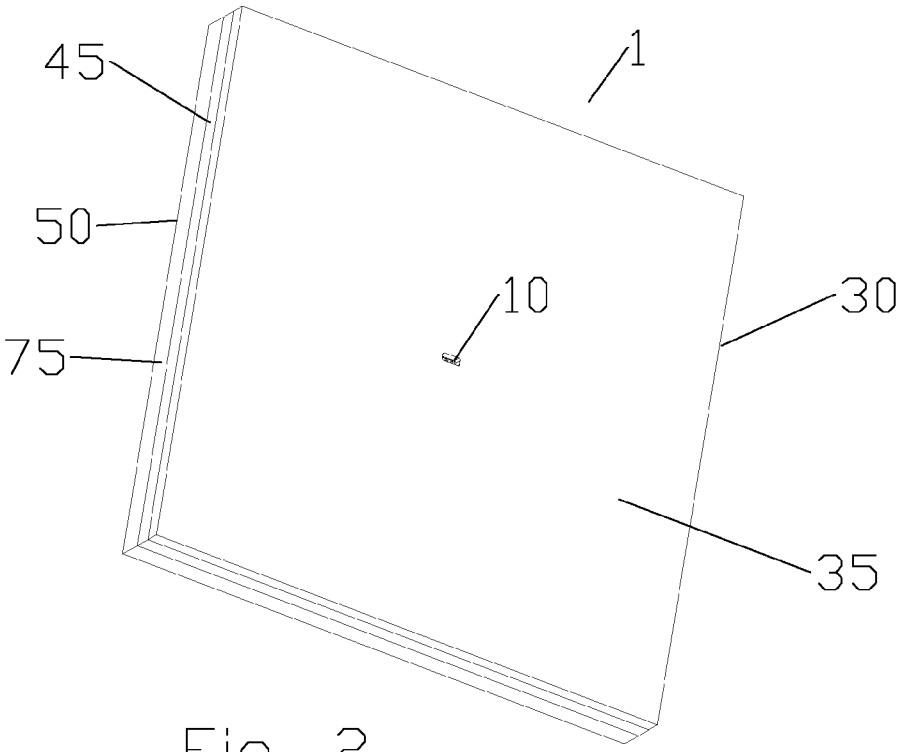
FIG. 2 is a schematic isometric angled back view of the flat panel antenna of FIG. 1.

The inventors have developed a flat panel antenna utilizing a corporate waveguide network and cavity couplers provided in stacked layers. The low loss 4-way coupling of each cavity coupler significantly simplifies the requirements of the corporate waveguide network, enabling higher feed horn density for improved electrical performance. The layered configuration enables cost efficient precision mass production.

As shown in FIGS. 1-8, a first embodiment of a flat panel array antenna 1 is formed from several layers, each with surface contours and apertures, combining to form a feed horn array 4 and RF path comprising a series of enclosed coupling cavities and interconnecting waveguides when the layers are stacked upon one another.

The RF path comprises a waveguide network 5 coupling an input feed 10 to a plurality of primary coupling cavities 15. Each of the primary coupling cavities 15 is provided with four output ports 20, each of the output ports 20 coupled to a horn radiator 25.

The input feed 10 is demonstrated positioned generally central on a first side 30 of an input layer 35, for example to allow compact mounting of a microwave transceiver thereto, using antenna mounting features (not shown) interchangeable with those used with traditional reflector antennas. Alternatively, the input feed 10 may be positioned at a layer sidewall 40, between the input layer 35 and a first intermediate layer 45, enabling, for example, an antenna side by side with the transceiver configuration where the depth of the resulting flat panel antenna assembly is minimized.

Figure 3:
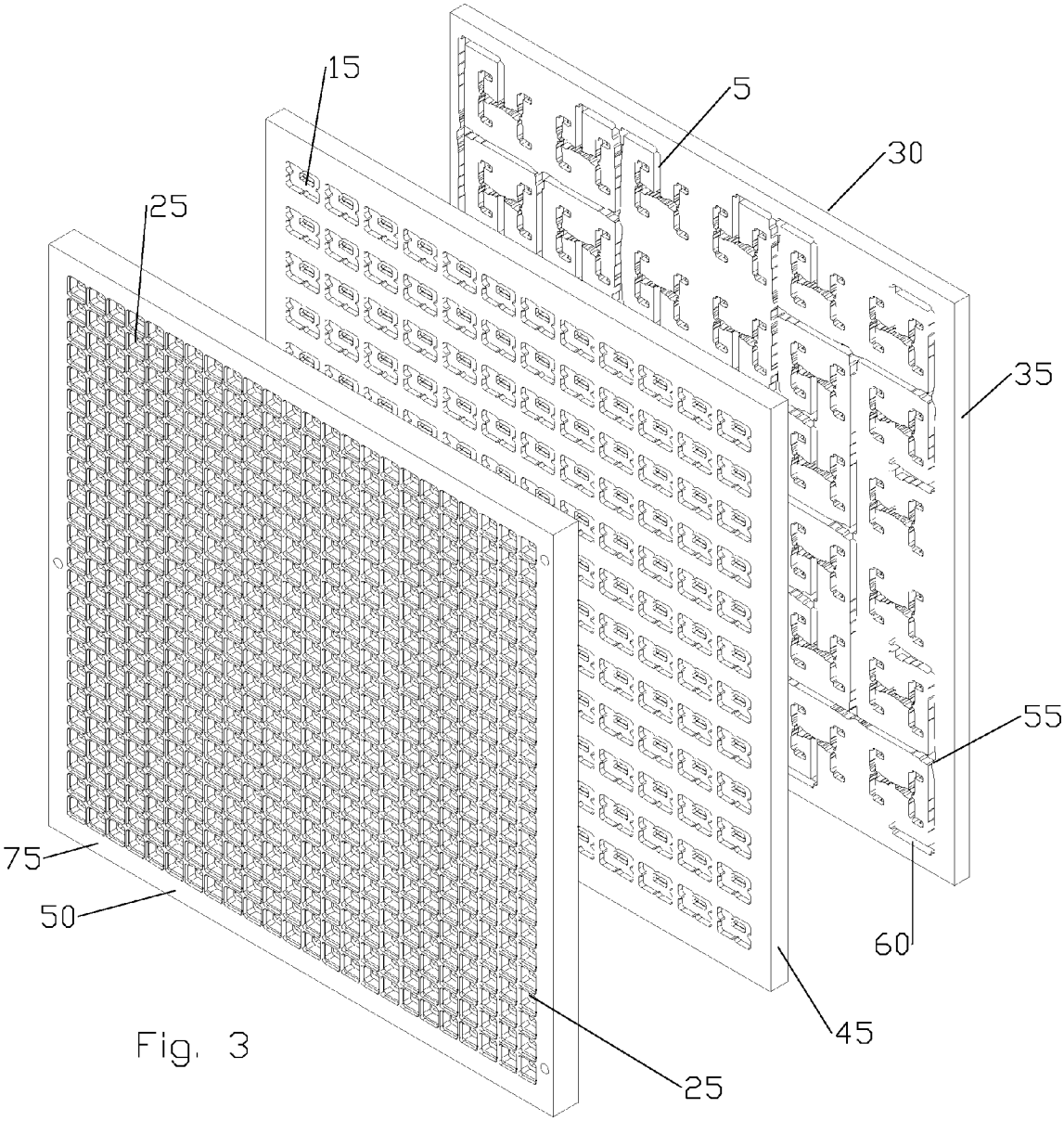
FIG. 3 is a schematic isometric exploded view of the antenna of FIG. 1.
Figure 4:
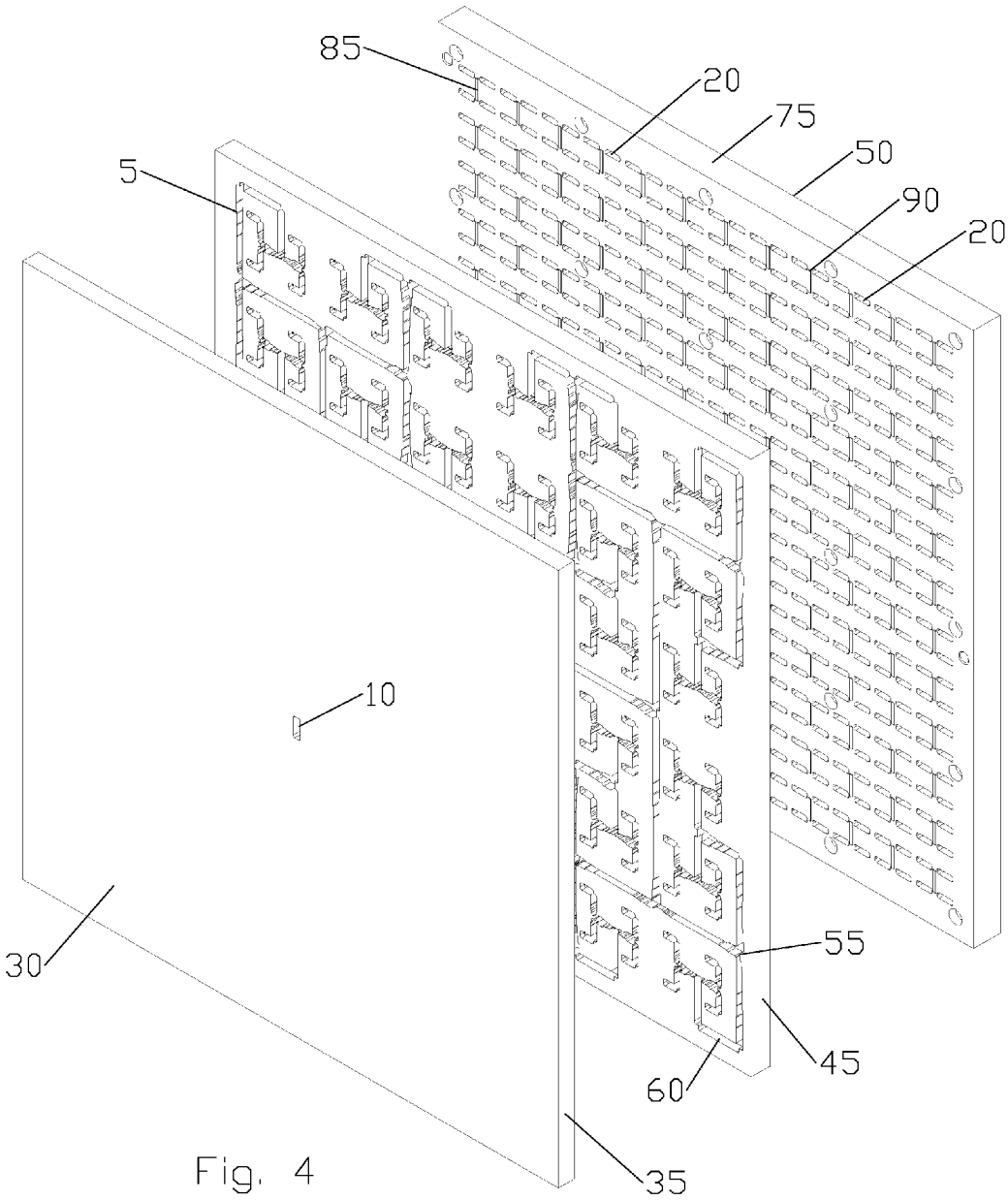
FIG. 4 is a schematic isometric exploded view of the antenna of FIG. 2.
Figure 5:
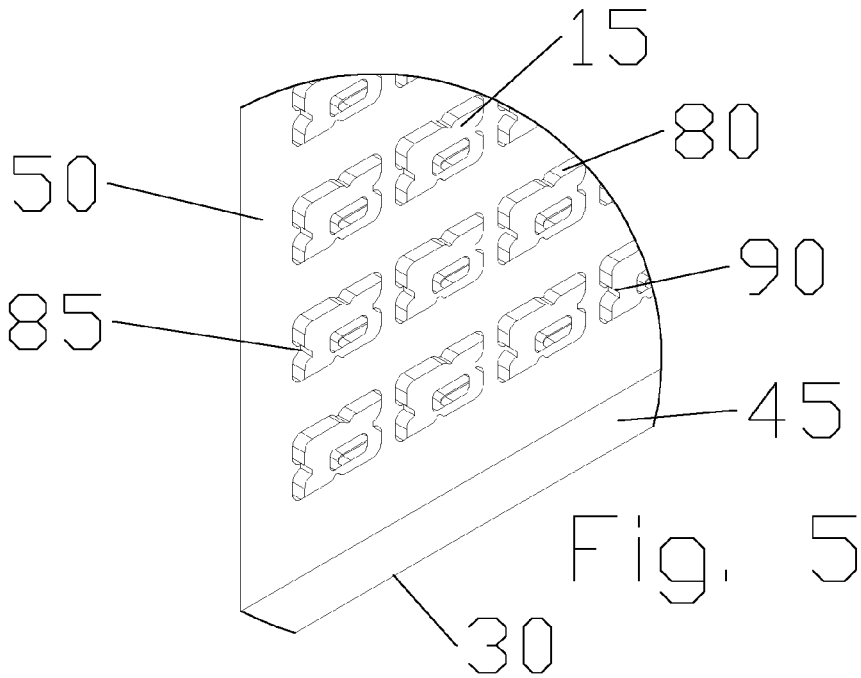
FIG. 5 is a close-up view of the second side of the intermediate layer of FIG. 3.
Figure 6:
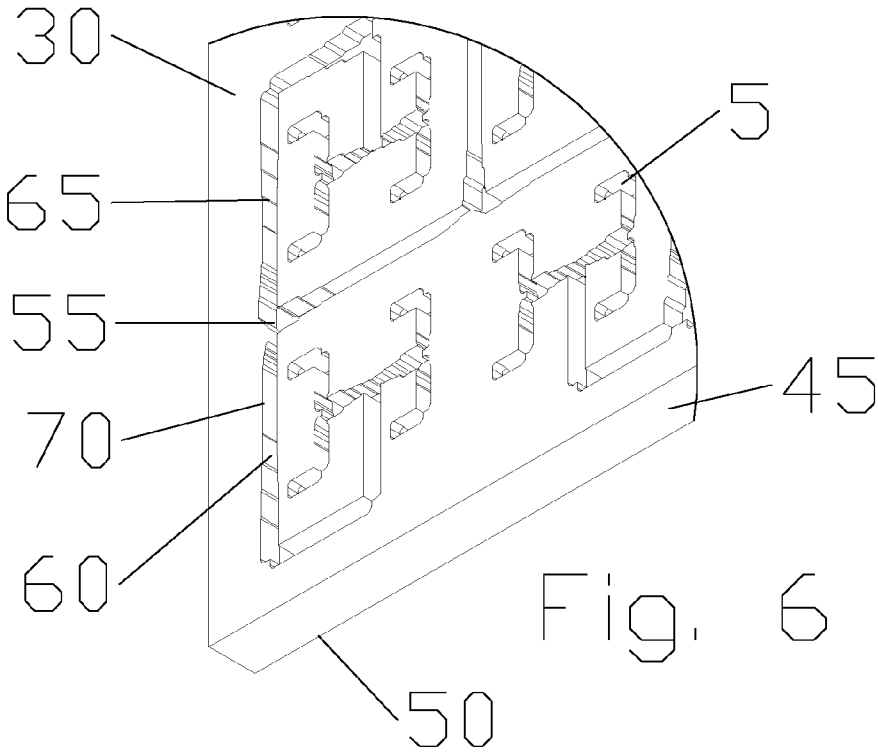
FIG. 6 is a close-up view of the first side of the intermediate layer of FIG. 3.
Figure 7:
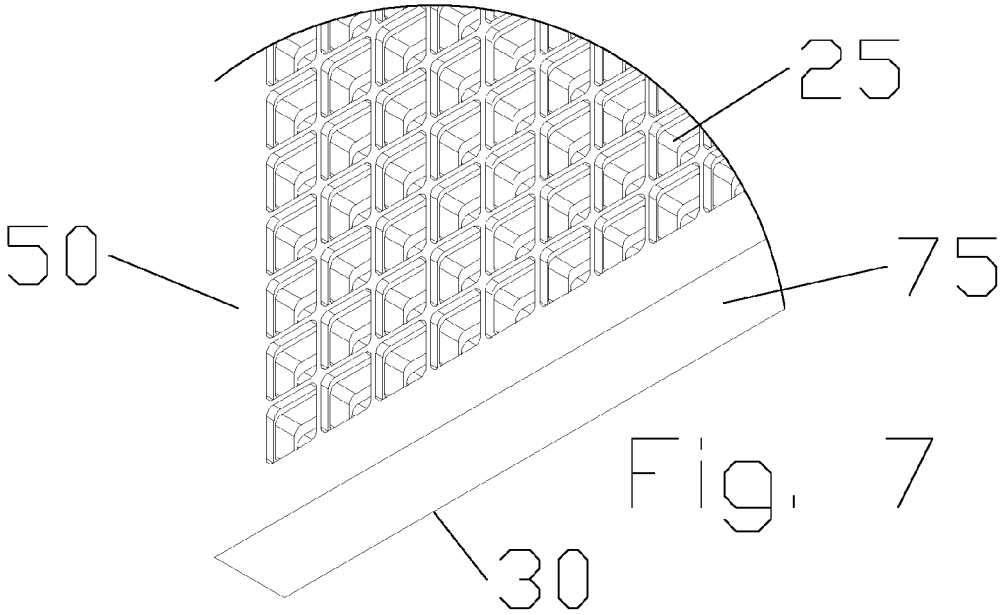
FIG. 7 is a close-up view of the second side of the output layer of FIG. 3.
Figure 8:
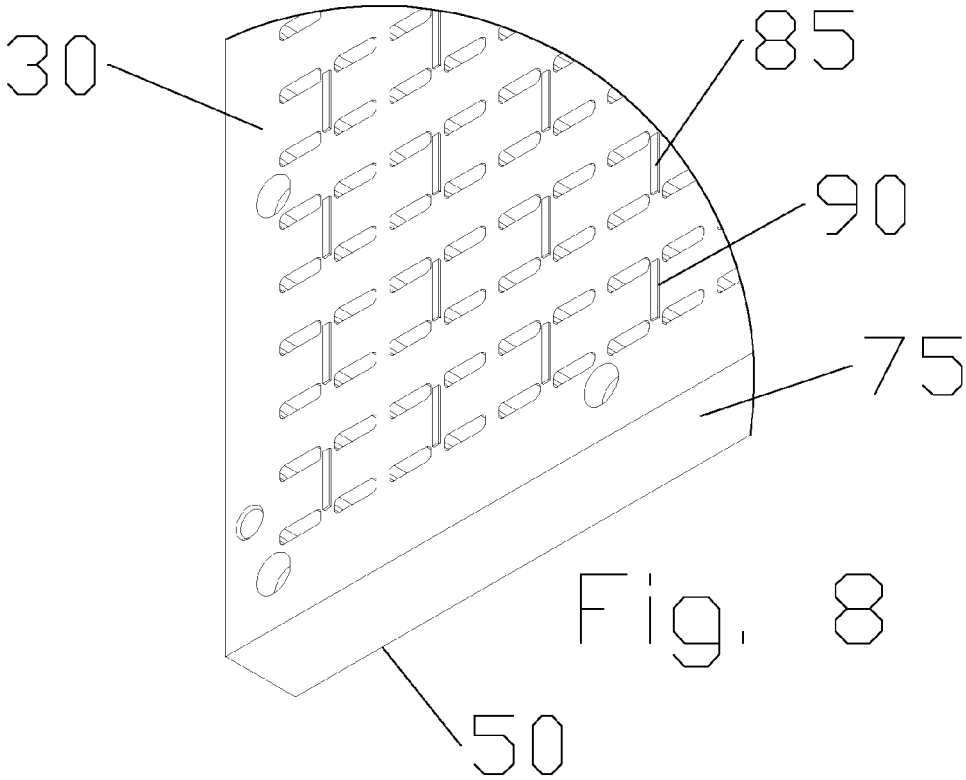
FIG. 8 is a close-up view of the first side of the output layer of FIG. 3.

As best shown on FIGS. 3, 4 and 6, the waveguide network 5 is demonstrated provided on a second side 50 of the input layer 35 and a first side 30 of the first intermediate layer 45. The waveguide network 5 distributes the RF signals to and from the input feed 10 to a plurality of primary coupling cavities 15 provided on a second side 50 of the first intermediate layer 45. The waveguide network 5 may be dimensioned to provide an equivalent length electrical path to each primary coupling cavity 55 to ensure common phase and amplitude. T-type power dividers 55 may be applied to repeatedly divide the input feed 10 for routing to each of the primary coupling cavities 15. The waveguide sidewalls 60 of the waveguide network may also be provided with surface features 65 for impedance matching, filters and/or attenuation.

Figure 9:
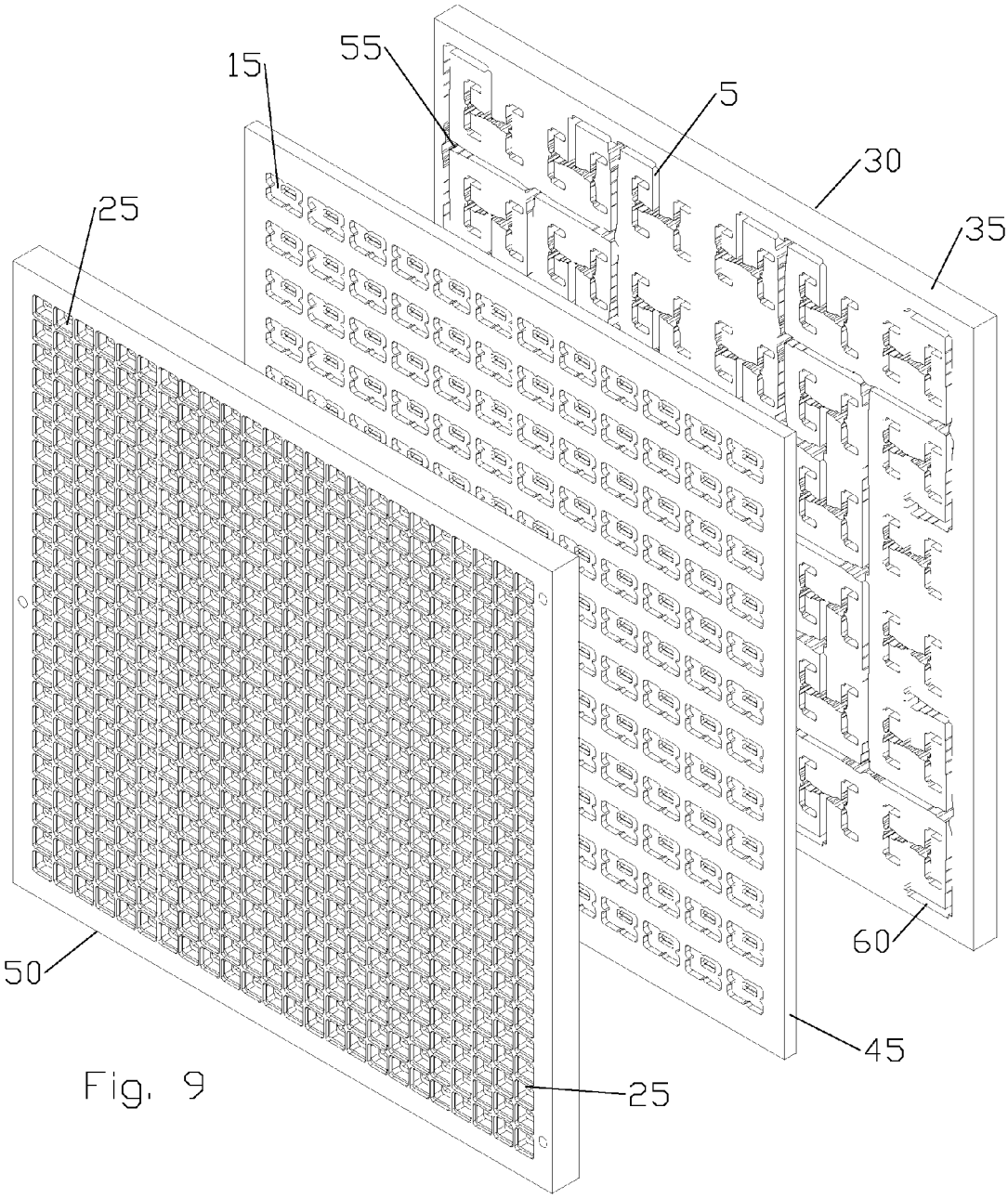
FIG. 9 is a schematic isometric angled front view of an alternative waveguide network embodiment of a flat panel antenna.
Figure 10:
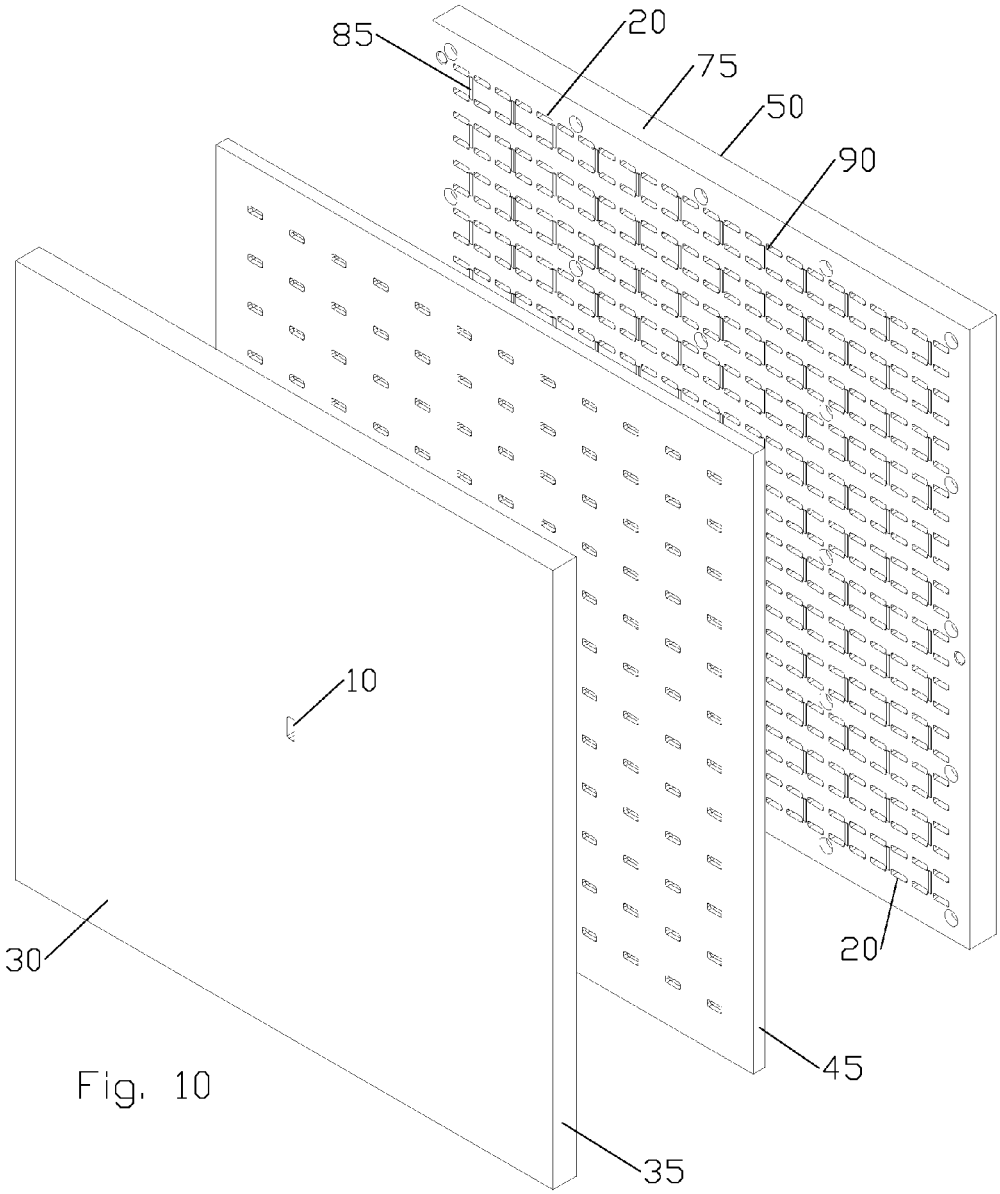
FIG. 10 is a schematic isometric angled back view of the flat panel antenna of FIG. 9.

The waveguide network 5 may be provided with a rectangular waveguide cross section, where a long axis of the rectangular cross section normal to a surface plane of the input layer 35 (see FIG. 6). Alternatively, the waveguide network 5 may be configured such that a long axis of the rectangular cross section is parallel to a surface plane of the input layer 35. A seam 70 between the input layer 35 and the first intermediate layer 45 may be applied at a midpoint of the waveguide cross section, as shown for example in FIG. 6. Thereby, any leakage and/or dimensional imperfections appearing at the layer joint are at a region of the waveguide cross section where the signal intensity is reduced or minimized. Further, any sidewall draft requirements for manufacture of the layers by injection molding mold separation may be reduced or minimized, as the depth of features formed in either side of the layers is halved. Alternatively, the waveguide network 5 may be formed on the second side 50 of the input layer 35 or the first side 30 of the first intermediate layer 45 with the waveguide features at full waveguide cross-section depth in one side or the other, and the opposite side operating as the top or bottom sidewall, closing the waveguide network 5 as the layers are seated upon one another (see FIGS. 9 and 10).

The primary coupling cavities 15, each fed by a connection to the waveguide network 5, provide −6 dB coupling to four output ports 20. The primary coupling cavities 15 have a rectangular configuration with the waveguide network connection and the four output ports 20 on opposite sides. The output ports 20 are provided on a first side 30 of an output layer 75, each of the output ports 20 in communication with one of the horn radiators 25, the horn radiators 25 provided as an array of horn radiators 25 on a second side 50 of the output layer 75. As shown for example in FIG. 5, the sidewalls 80 of the primary coupling cavities 15 and/or the first side 30 of the output layer 75 may be provided with tuning features 85 such as septums 90 projecting into the primary coupling cavities 15 or grooves 95 forming a depression to balance transfer between the waveguide network 5 and the output ports 20 of each primary coupling cavity 15. The tuning features 85 may be provided symmetrical with one another on opposing surfaces and/or spaced equidistant between the output ports 20.

To balance coupling between each of the output ports 20, each of the output ports 20 may be configured as rectangular slots run parallel to a long dimension of the rectangular cavity and the input waveguide. Similarly, the short dimension of the output ports 20 may be aligned parallel to the short dimension of the cavity which is parallel to the short dimension of the input waveguide.

When using array element spacing of between 0.75 and 0.95 wavelengths to provide acceptable array directivity, with sufficient defining structure between elements, a cavity aspect ratio, may be, for example, 1.5:1.

An exemplary cavity may be dimensioned with:

a depth less than 0.2 wavelengths, a width close to n×wavelengths, and a length close to n×3/2 wavelengths.

The array of horn radiators 25 on the second side 50 of the output layer 75 improves directivity (gain), with gain increasing with element aperture until element aperture increases past one wavelength and grating lobes begin to be introduced. One skilled in the art will appreciate that because each of the horn radiators 20 is individually coupled in phase to the input feed 10, the prior low density ½ wavelength output slot spacing typically applied to follow propagation peaks within a common feed waveguide slot configuration has been eliminated, allowing closer horn radiator 20 spacing and thus higher overall antenna gain.

Because an array of small horn radiators 20 with common phase and amplitude are provided, the amplitude and phase tapers observed in a conventional single large horn configuration that may otherwise require adoption of an excessively deep horn or reflector antenna configuration have been eliminated.

One skilled in the art will appreciate that the simplified geometry of the coupling cavities and corresponding reduction of the waveguide network requirements enables significant simplification of the required layer surface features which reduces overall manufacturing complexity. For example, the input, first intermediate, second intermediate (if present) and output layers 35, 45, 75 may be formed cost effectively with high precision in high volumes via injection molding and/or die-casting technology. Where injection molding with a polymer material is used to form the layers, a conductive surface may be applied.

Although the coupling cavities and waveguides are described as rectangular, for ease of machining and/or mold separation, corners may be radiused and/or rounded in a trade-off between electrical performance and manufacturing efficiency.

As frequency increases, wavelengths decrease. Therefore, as the desired operating frequency increases, the physical features within a corporate waveguide network, such as steps, tapers and T-type power dividers, become smaller and harder to fabricate. As use of the coupling cavities simplifies the waveguide network requirements, one skilled in the art will appreciate that higher operating frequencies are enabled by the present flat panel antenna, for example up to 26 GHz, above which the required dimension resolution/feature precision may begin to make fabrication with acceptable tolerances cost prohibitive.

For further ease of cost efficient and/or high precision manufacture, the input layer 35 and waveguide network 5 thereon for a plurality of different flat panel antenna configurations may be formed utilizing one or more modular segments. A generally rectangular, such as a square, segment base 103, as shown for example in FIGS. 11-14, has a feed aperture 107 and waveguide network 5. In addition to the feed aperture 107, the segment base 103 may be provided with a corner cavity 109 at each corner and a tap cavity 111 at a mid-section of each of two opposite sides. A plurality of additional waveguide paths are provided on the first side 30 for interconnecting multiple segment bases 103 to form a waveguide network coupling to a larger number of output ports 20 provided on the corresponding segment tops 121 of adjacent segment bases 103. The additional waveguide paths include a central waveguide 115 between the feed aperture 107 and the tap cavities 111, a peripheral waveguide 117 between each of the corner cavities 109 that are adjacent to one another and a feed waveguide 119 between the feed aperture 107 and the output ports 20 provided on a segment top 121 dimensioned to seat upon the first side 30 of the segment base 103 to form a segment pair 122.

The segment top 121 may be provided with a mirror image of the waveguide network 5, the segment top 121 providing a second half of each of the central waveguides 115, and the peripheral waveguides 117 and the feed waveguides 119 of the segment base 103. Alternatively, the segment top 121 may be provided planar, providing the top sidewall of the waveguide network 5. The segment top 121 may be further provided as one of the additional layers of a flat panel antenna configuration, such as a first intermediate layer 45 or an output layer 75 of a flat panel array antenna 1. Where the segment top 121 is one of the additional layers of the flat panel antenna 1, a single layer may provide a combined segment top of multiple segment bases 103.

A range of different feed, power divider and bypass taps, for example as shown in FIGS. 15-20, may be seated within the feed aperture 107 and/or within the apertures formed by adjacent corner or tap cavities 109, 111 to generate a waveguide network 5 which links an input feed 10 of the selected feed tap 123 with each of the output ports 20 along generally equidistant paths through the waveguide network 5, to provide uniform phase and signal levels at each of, for example, horn radiators 25 each output port 20 is finally coupled to. To simplify manufacturing requirements, the feed, power and/or bypass taps may be formed in two part form, for example by machining, die casting and/or injection molding.

Figure 13:
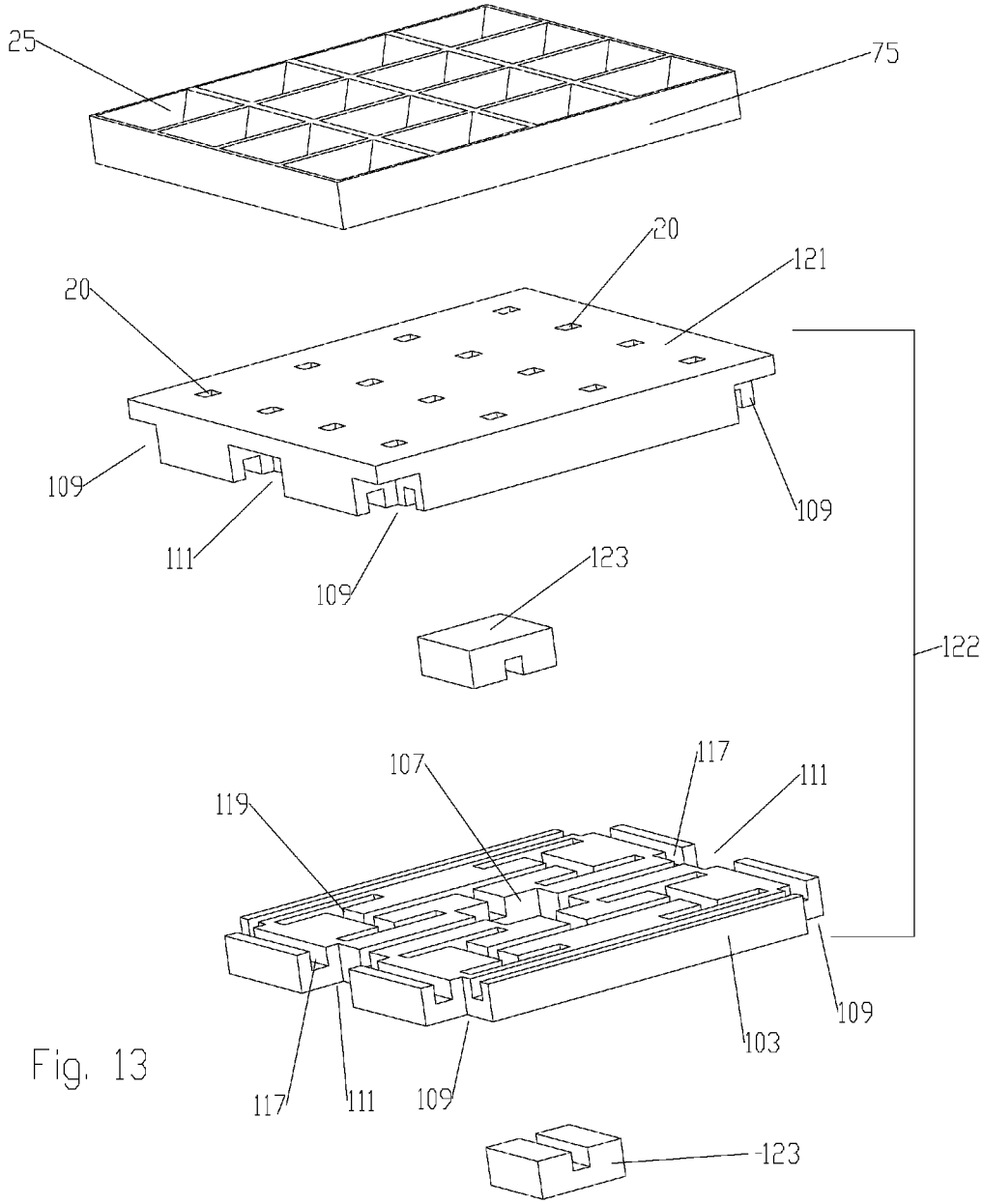
FIG. 13 is an exploded angled top isometric view of a flat panel antenna utilizing a single segment pair.
Figure 14:
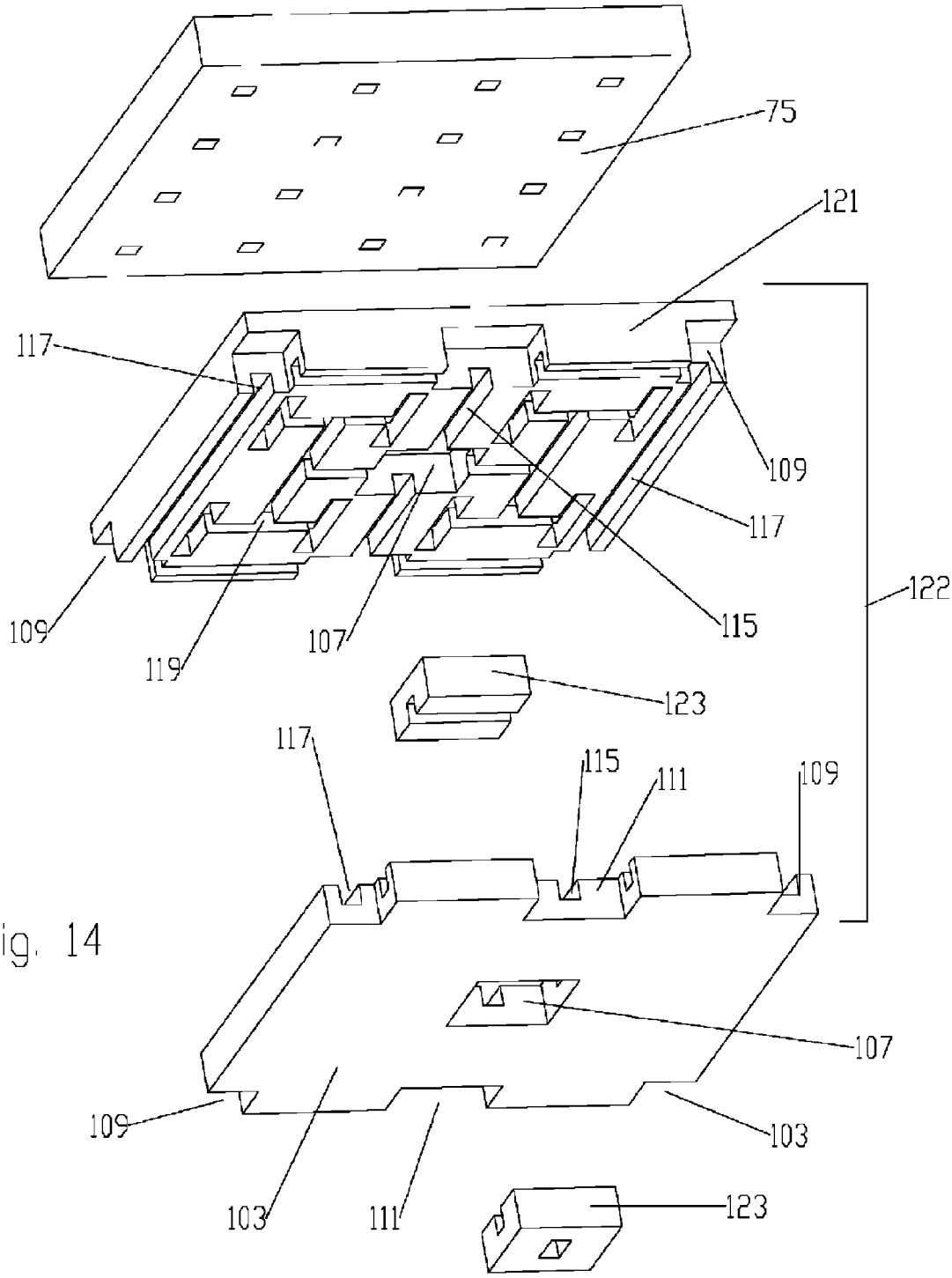
FIG. 14 is an exploded isometric angled bottom view of the flat panel antenna of FIG. 13.
Figure 15:
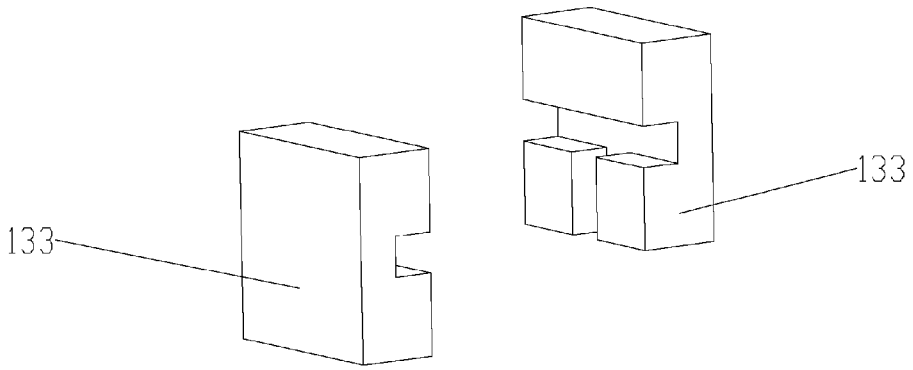
FIG. 15 is a schematic isometric view of a feed power divider tap.
Figure 16:
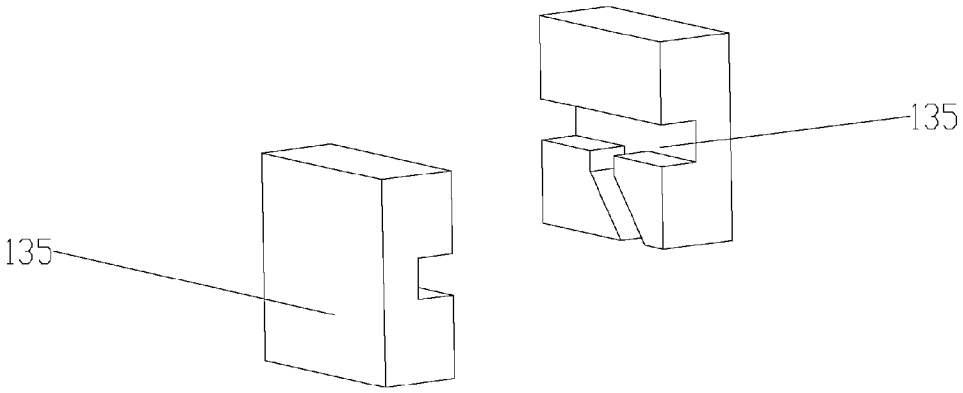
FIG. 16 is a schematic isometric view of a central power divider tap.
Figure 17:
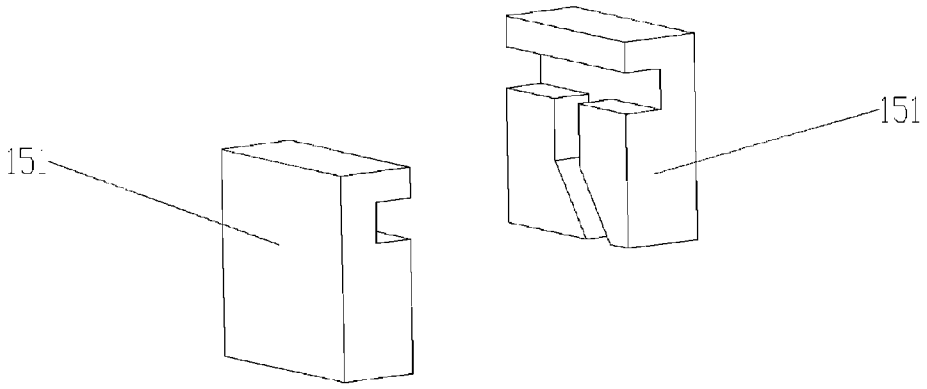
FIG. 17 is a schematic isometric view of a peripheral power divider tap.
Figure 18:
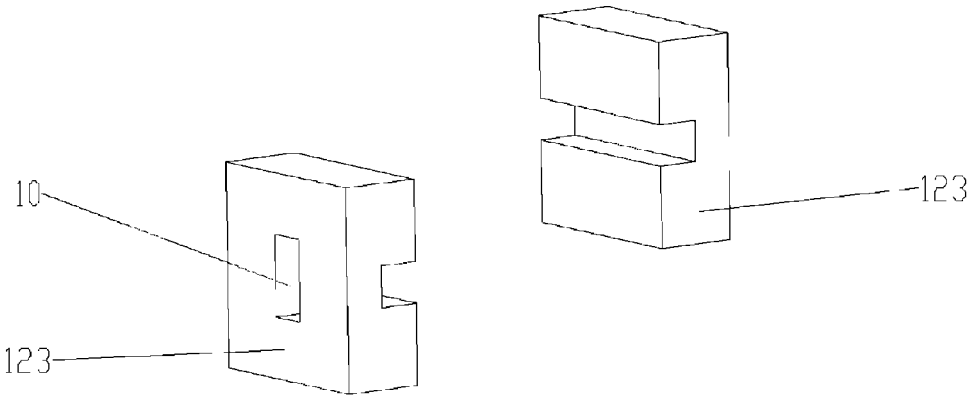
FIG. 18 is a schematic isometric view of a feed tap.
Figure 19:
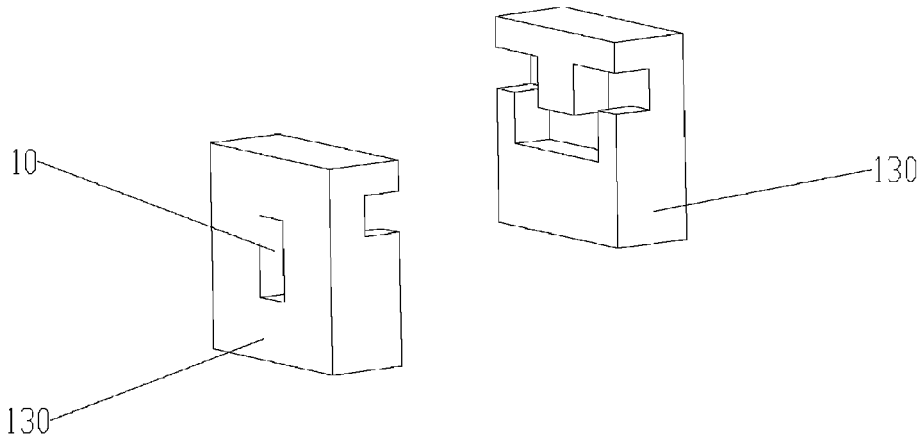
FIG. 19 is a schematic isometric view of a peripheral feed tap.
Figure 20:
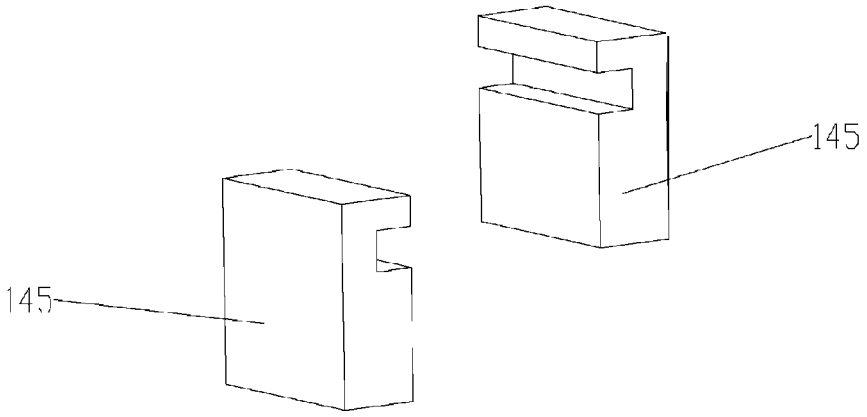
FIG. 20 is a schematic isometric view of a bypass tap.

In a small waveguide network configuration, for example as shown in FIGS. 13 and 14, a feed tap 123 dimensioned to couple the input feed 10 to the feed waveguide 119 is inserted into the feed aperture 107. Thereby, the input feed 10 is coupled to the sixteen output ports 20 of the segment top and therethrough to the corresponding array of horn radiators 25 provided on the exemplary output layer 75.

Figure 21:
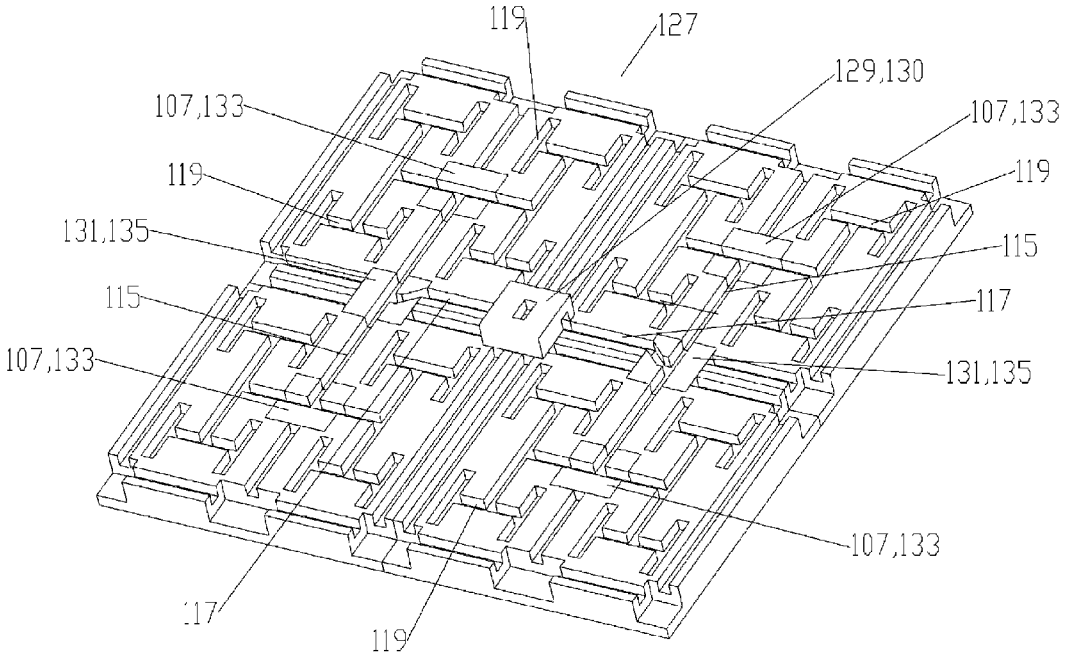
FIG. 21 is a schematic isometric view of a 2×2 modular segment with the segment top and one half of the power dividers removed for clarity.

The segment pairs 122 may alternatively be configured side to side, for example as shown in FIG. 21, in a 2×2 modular segment embodiment utilizing four segment pairs 122. In the 2×2 modular segment 127, the corner cavities 109 of each of the segment pairs 122 at a center of the 2×2 modular segment 127 combine to form a 2×2 feed aperture 129 and the tap cavities 111 of each of the segment pairs 122 adjacent to one another together form 2×2 power divider cavities 131. A peripheral feed tap 130 is inserted in the 2×2 feed aperture 129, provided with an input feed 10 coupled to a central power divider tap 135 provided in each of the 2×2 power divider cavities 131 via at least one of the peripheral waveguides 117 there between. The central power divider taps 135 are coupled to feed power divider taps 133 provided in each of the feed apertures 107 of each segment pair 122 via the central waveguide 115 therebetween. The feed power divider taps 133 are coupled to the output ports 20 of each segment pair 122 via the feed waveguide 119. Thereby, a signal provided at the input feed 10 is distributed to each of the combined sixty-four output ports 20 of the corresponding segment tops 121.

Figure 22:
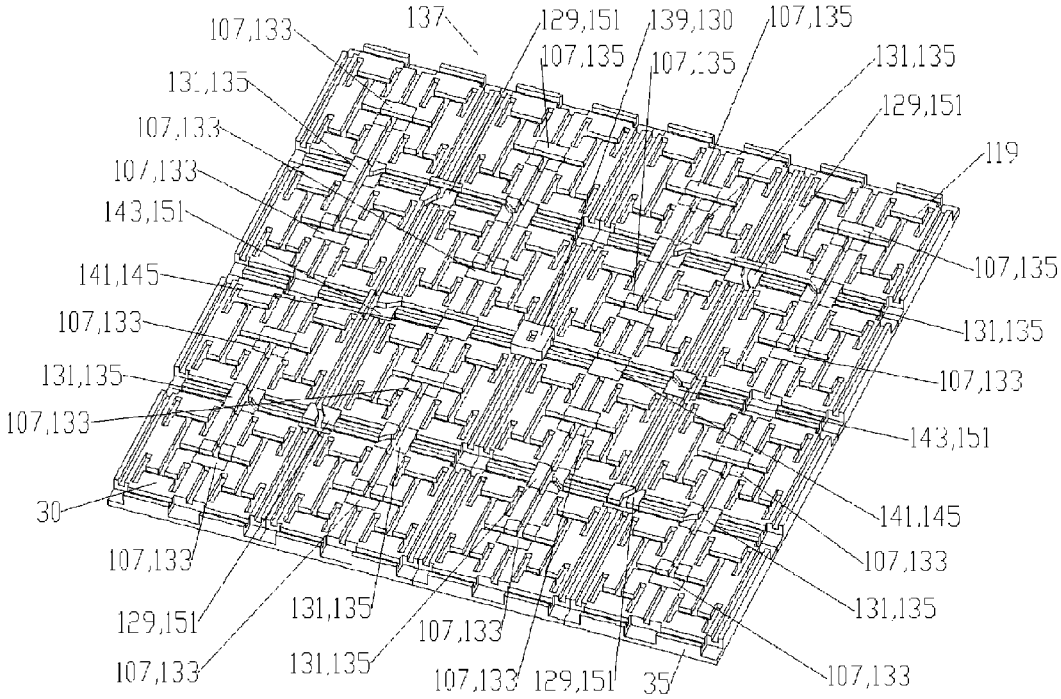
FIG. 22 is a schematic isometric view of a 4×4 modular segment with the segment top and one half of the power dividers removed for clarity.

An even larger waveguide network 5 may be formed from segment pairs 122, for example, by interconnecting sixteen of the segment pairs 122 in a side to side matrix to form a generally planar 4×4 modular segment, for example as shown in FIG. 22. Details of the 4×4 modular segment 137 and the interconnections forming the waveguide network 5 thereof will be described with respect to grouping four 2×2 modular segments 127, as described herein above, together. The generally planar 4×4 matrix of segment pairs 122 has a 4×4 feed aperture 139 defined by the combined corner cavities 109 of the segment pairs 122 at the center of the 4×4 modular segment 137. The tap cavities 111 of the segment pairs 122 adjacent the center of the 4×4 modular segment 137 combine to form bypass cavities 141 and the corner cavities 109 of the segment pairs 122 adjacent the bypass cavities 141 and in-line with the 4×4 feed aperture 139, form 4×4 power divider cavities 143.

A peripheral feed tap 130 with an input feed 10 is seated within the 4×4 feed aperture 139. The peripheral feed tap 130 is coupled to a bypass tap 145 (see FIG. 20) provided in each of the bypass cavities 141 via at least one of the peripheral waveguides 117 there between. A peripheral power divider tap 151 is seated in each of the 4×4 power divider cavities 143; the peripheral power divider taps 151 and coupled to the respective bypass taps 145 via at least one of the peripheral waveguides 117 there between.

The corner cavities 109 of each of the segment pairs 122 at a center of each of the 2×2 modular segments 127 combine to form a 2×2 feed aperture 129 and the tap cavities 111 of each of the segment pairs 122 adjacent to one another in each 2×2 modular segment 127 together form a 2×2 power divider cavity 131.

Another peripheral power divider tap 151 is provided in each 2×2 feed aperture 129, coupling with the peripheral power divider tap 151 of the 4×4 power divider cavities 143 via the peripheral waveguide 117 there between. The peripheral power divider taps 151 of the 2×2 feed apertures 129 are coupled to the central power divider taps 135 seated in the 2×2 power divider cavities by at least one of the peripheral waveguides 117 there between. The central power divider taps 135 are each coupled to a feed power divider tap 133 provided in each of the 2×2 power divider cavities 131 via the central waveguide 115 there between. The feed power divider taps 133 are coupled to the output ports 20 of each segment pair 122 via the feed waveguide 119 there between. Thereby, a signal provided at the input feed 10 is distributed to each of the combined two hundred and fifty-six output ports 20 of the corresponding segment tops 121.

Figure 11:
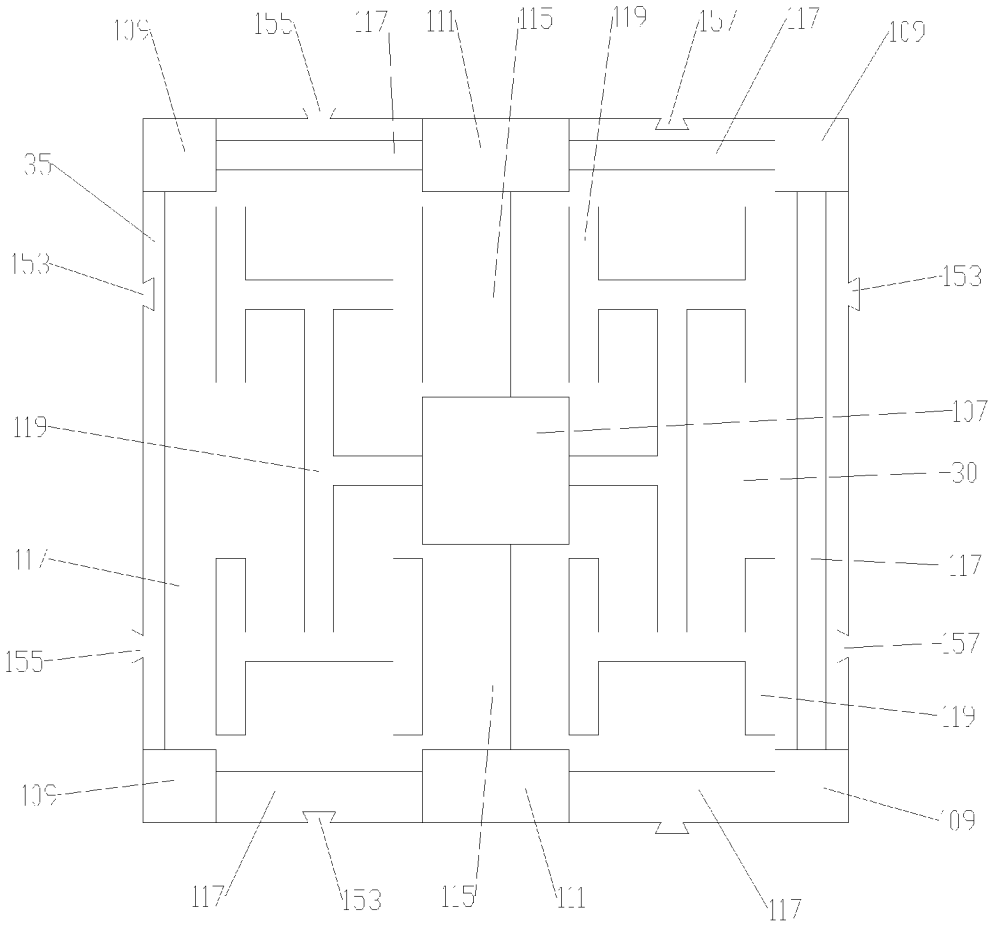
FIG. 11 is a schematic top view of the first side of an exemplary segment base.
Figure 12:
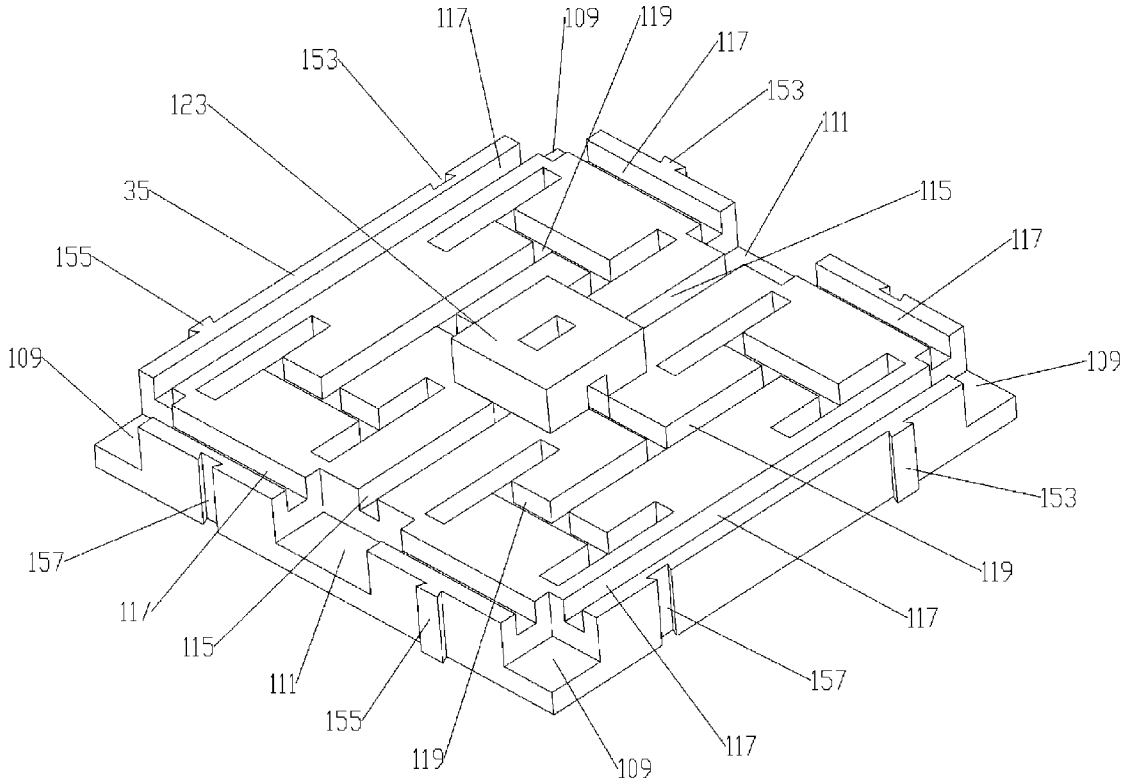
FIG. 12 is a schematic isometric view of the segment base of FIG. 11, with a feed tap seated in the feed aperture.

The precision alignment and/or mechanical interconnection of the segment pairs 122 with one another and/or with adjacent equipment and/or further layers may be simplified by providing retention features 153 along a periphery of the segment pair 122. For example as shown in FIGS. 11 and 12, the retention features 153 may be provided as complementary tabs 155 and slots 157 enabling snap together interconnection with each other and/or corresponding tabs and slots provided in surrounding elements, such as a frame and/or radome.

One skilled in the art will appreciate that selection of the feed, power divider and/or bypass taps to interconnect a waveguide path along segment pairs 122 each with an identical array of available waveguide channels enables generation of a waveguide path between the feed aperture 107 and each of the output ports 20 that has a generally equivalent length. Thereby, phase and/or signal strength errors generated by the division of the input signal to each of the output ports 20 may be avoided.

The use of segment pairs 122 may significantly simplify manufacturing requirements of the flat panel antenna 1. The segment base 103 and segment top 121 may be formed, for example, by machining, die casting and/or injection molding. A polymer material machined and/or injection molded segment base 103 and/or segment top 121 may be metalized or metal coated.

One skilled in the art will appreciate that fabrication of a universal segment base 103 and/or segment top 121 may reduce duplicate tooling and quality control requirements for a family of flat panel antennas. Where machining is applied, the segment pairs 122 may be formed via smaller pieces of stock material, reducing material costs and enabling a smaller required range of motion from the machining tool(s). Where fabrication via die casting and/or injection molding is applied, the die size and complexity of the die may be reduced. Further, with a smaller die and/or mold requirement, the separation characteristics are improved which may reduce the compromises required with respect to mold draft requirements. Where a further metal coating and/or metalizing step is applied to a, for example, polymer injection molded base component, such may be similarly simplified by being applied to a smaller total area.

From the foregoing, it will be apparent that the present invention brings to the art a modular feed network usable, for example, as the waveguide network 5 of a high performance flat panel antenna with reduced cross section that is strong, lightweight and may be repeatedly cost efficiently manufactured with a high level of precision. Utilizing segment pairs 122 to form the waveguide network 5 further may enable fabrication of a single segment base 103 and/or segment top 121 cost efficiently and with improved precision. Where the segment pairs 122 are formed via die casting or injection molding, the single die and/or mold required for manufacture of a family of antennas is simplified and the reduced size of such may simplify mold separation and thus draft requirements of the waveguide network features, improving the cross section of the waveguide and thereby overall electrical performance.

Table of Parts

| | |
|---|---|
| 1 | flat panel array antenna |
| 5 | waveguide network |
| 10 | input feed |
| 15 | primary coupling cavity |
| 20 | output port |
| 25 | horn radiator |
| 30 | first side |
| 35 | input layer |
| 40 | layer sidewall |
| 45 | first intermediate layer |
| 50 | second side |
| 55 | T-type power divider |
| 60 | waveguide sidewalls |
| 65 | surface features |
| 70 | seam |
| 75 | output layer |
| 80 | sidewall |
| 85 | tuning feature |
| 90 | septum |
| 95 | groove |
| 103 | segment base |
| 107 | feed aperture |
| 109 | corner cavity |
| 111 | tap cavity |
| 115 | central waveguide |
| 117 | peripheral waveguide |
| 119 | feed waveguide |
| 121 | segment top |
| 122 | segment pair |
| 123 | feed tap |
| 127 | 2 × 2 modular segment |
| 129 | 2 × 2 feed aperture |
| 130 | peripheral feed tap |
| 131 | 2 × 2 power divider cavity |
| 133 | feed power divider tap |
| 135 | central power divider tap |
| 137 | 4 × 4 modular segment |
| 139 | 4 × 4 feed aperture |
| 141 | bypass cavity |
| 143 | 4 × 4 power divider cavity |
| 145 | bypass tap |
| 151 | peripheral power divider tap |
| 153 | retention feature |
| 155 | tab |
| 157 | slot |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A modular feed network, comprising:

a generally rectangular segment base provided with a feed aperture; a corner cavity at each corner and a tap cavity at a mid-section of each of two opposite sides; and a segment top provided with a plurality of output ports; the segment top provided seated upon a first side of the segment base to form a segment pair;

the segment base provided with a central waveguide, on the first side, between the feed aperture and the tap cavities;

the segment base provided with a peripheral waveguide, on the first side, between each of the corner cavities that are adjacent to one another;

the segment base provided with a feed waveguide between the feed aperture and the output ports.

2. The modular feed network of claim 1, wherein a path between the feed aperture and each of the output ports has a generally equivalent length.

3. The modular feed network of claim 1, further including retention features provided on a periphery of the segment pair; the retention features dimensioned for mechanical coupling of the segment pair to additional segment pairs, side to side.

4. The modular feed network of claim 1, wherein the segment top is provided with a mirror image waveguide network; the mirror image waveguide network providing a second half of each of the central waveguide, the peripheral waveguide and the feed waveguide of the segment base.

5. The modular feed network of claim 1, wherein the segment top is a first intermediate layer of a flat panel array antenna.

6. The modular feed network of claim 1, wherein the segment top is an output layer of a flat panel array antenna.

7. The modular feed network of claim 1, wherein there are four segment pairs arranged side-to-side to form a generally planar 2×2 modular segment.

8. The modular feed network of claim 7, wherein the corner cavities of each of the segment pairs at a center of the 2×2 modular segment combine to form a 2×2 feed aperture;

the tap cavities of each of the segment pairs adjacent to one another together forming a 2×2 power divider cavity;

a peripheral feed tap provided in the 2×2 feed aperture; the peripheral feed tap provided with an input feed coupled to a feed power divider tap provided in each of the 2×2 power divider cavities via at least one of the peripheral waveguides therebetween;

the feed power divider taps coupled to a central power divider tap provided in each of the feed apertures of each segment pair via the central waveguide therebetween;

the central power divider taps coupled to the output ports of each segment pair via the feed waveguide.

9. The modular feed network of claim 7, wherein there are four 2×2 modular segments arranged side by side to form a generally planar 4×4 modular segment.

10. The modular feed network of claim 9, wherein the corner cavities of each of the segment pairs at a center of the 4×4 modular segment combine to form a 4×4 feed aperture;

the tap cavities of the segment pairs adjacent the center of the 4×4 modular segment combine to form bypass cavities;

the corner cavities of the segment pairs adjacent the bypass cavities and in-line with the 4×4 feed aperture, forming 4×4 power divider cavities;

the corner cavities of each of the segment pairs at a center of each of the 2×2 modular segments combine to form a 2×2 feed aperture;

the tap cavities of each of the segment pairs adjacent to one another in each 2×2 modular segment together forming a 2×2 power divider cavity;

a peripheral feed tap provided in the 4×4 feed aperture; the peripheral feed tap provided with an input feed coupled to a bypass tap provided in each of the bypass cavities via at least one of the peripheral waveguides therebetween;

a peripheral power divider tap provided in each of the 4×4 power divider cavities and the 2×2 power divider cavities;

the peripheral power divider tap of the 4×4 power divider cavities coupled to the bypass taps via at least one of the peripheral waveguides therebetween;

the peripheral power divider taps of the 4×4 power divider cavities coupled to the peripheral power divider taps of the 2×2 feed aperture via at least one of the periphery waveguides therebetween;

the peripheral power divider tap of the 2×2 feed aperture tap coupled to a central power tap provided in each of the 2×2 power divider cavities via the peripheral waveguides therebetween;

the central power divider taps coupled to a feed power divider tap provided in each of the feed apertures of each of the segment pairs via the central waveguide therebetween;

the central feed taps coupled to the output ports of each segment pair via the feed waveguide therebetween.

11. A method for manufacture of a modular feed network, comprising:

forming a generally rectangular segment base provided with a feed aperture; a corner cavity at each corner of the segment base and a tap cavity of the segment base provided at a mid-section of each of two opposite sides of the segment base; and forming a segment top provided with a plurality of output ports; and seating the segment top upon a first side of the segment base to form a segment pair;

the segment base provided with a central waveguide, on the first side, between the feed aperture and the tap cavities;

the segment base provided with a peripheral waveguide, on the first side, between each of the corner cavities that are adjacent to one another;

the segment base provided with a feed waveguide between the feed aperture and the output ports.

12. The method of claim 11, wherein a waveguide path between the feed aperture and each of the output ports has a generally equivalent length.

13. The method of claim 11, further including providing retention features on a periphery of the segment pair; the retention features dimensioned for mechanical coupling of the segment pair to additional segment pairs, side to side.

14. The method of claim 11, wherein the segment top is provided with a mirror image waveguide network; the mirror image waveguide network providing a second half of each of the central waveguide, the peripheral waveguide and the feed waveguide of the segment base.

15. The method of claim 11, wherein the segment top is a first intermediate layer of a flat panel array antenna.

16. The method of claim 11, wherein the segment top is an output layer of a flat panel array antenna.

17. The method of claim 11, wherein the segment base is formed via injection molding.

18. The method of claim 11 wherein the segment base is formed via die casting.

19. The method of claim 11, further including the step of arranging four segment pairs side-to-side to form a generally planar 2×2 modular segment.

20. The method of claim 19, further including the step of arranging four of the 2×2 modular segments side by side to form a generally planar 4×4 modular segment.

* * * * *